US009707605B2

(12) United States Patent
Zhu et al.

(10) Patent No.: US 9,707,605 B2
(45) Date of Patent: Jul. 18, 2017

(54) SMALL PARTICLE SIZE OIL IN WATER LUBRICANT FLUID

(75) Inventors: Tao Zhu, Shanghai (CN); Pieter Schellingerhout, Ulthoorn (NL); Yuming Zhang, Shanghai (CN); Jiangbo Ma, Shanghai (CN)

(73) Assignee: QUAKER CHEMICAL CORPORATION, Conshohocken, PA (US)

( * ) Notice: Subject to any disclaimer, the term of this patent is extended or adjusted under 35 U.S.C. 154(b) by 535 days.

(21) Appl. No.: 13/319,006

(22) PCT Filed: May 10, 2010

(86) PCT No.: PCT/US2010/034229

§ 371 (c)(1),
(2), (4) Date: Jun. 17, 2012

(87) PCT Pub. No.: WO2010/129951

PCT Pub. Date: Nov. 11, 2010

(65) Prior Publication Data

US 2012/0245067 A1 Sep. 27, 2012

Related U.S. Application Data

(60) Provisional application No. 61/176,666, filed on May 8, 2009.

(51) Int. Cl.
*C10M 105/48* (2006.01)
*C10M 105/34* (2006.01)
(Continued)

(52) U.S. Cl.
CPC ..... *B21B 45/0242* (2013.01); *C10M 173/00* (2013.01); *C10M 2203/1006* (2013.01);
(Continued)

(58) Field of Classification Search
CPC ..... C10M 2207/125; C10M 2207/281
(Continued)

(56) References Cited

U.S. PATENT DOCUMENTS 4,781,848 A * 11/1988 Biresaw et al. ..... 508/389
4,915,859 A 4/1990 Kerr et al.
(Continued)

FOREIGN PATENT DOCUMENTS

CN 1357032 7/2002
CN 1332001 8/2007
(Continued)

OTHER PUBLICATIONS

The International Search Report for International Patent Application No. PCT/US2010/034229, dated Jun. 24, 2010, 4 pages.
(Continued)

*Primary Examiner* — Vishal Vasisth
(74) *Attorney, Agent, or Firm* — Morgan, Lewis & Bockius LLP

(57) ABSTRACT

An oil in water lubricant fluid for use in steel cold rolling, comprising an oil in water emulsion having a particle size of 1 μm or less, consisting of an oil phase and water, where the oil phase includes about 5 wt % to about 40 wt % of at least one polymeric surfactant, about 25 wt % to about 95 wt % base oil, about 0.2 wt % to about 10 wt % extreme pressure lubrication additives, and about 0.5 wt % to about 6 wt % other functional additives.

20 Claims, 10 Drawing Sheets

(51) Int. Cl.
*B21B 45/02* (2006.01)
*C10M 173/00* (2006.01)

(52) U.S. Cl.
CPC . *C10M 2207/2805* (2013.01); *C10M 2207/30* (2013.01); *C10M 2207/401* (2013.01); *C10M 2215/223* (2013.01); *C10M 2219/00* (2013.01); *C10M 2223/00* (2013.01); *C10N 2220/021* (2013.01); *C10N 2220/082* (2013.01); *C10N 2230/06* (2013.01); *C10N 2230/12* (2013.01); *C10N 2230/56* (2013.01); *C10N 2240/405* (2013.01); *C10N 2240/408* (2013.01)

(58) Field of Classification Search
USPC ..... 508/459, 463
See application file for complete search history.

(56) References Cited

U.S. PATENT DOCUMENTS 6,245,723 B1 * 6/2001 Sigg et al. ..... 508/315
6,548,453 B1 4/2003 Narasimhan et al.
6,548,456 B1 * 4/2003 Mulder et al. ..... 508/268
2001/0049344 A1 * 12/2001 Levy ..... C10M 111/04 508/118
2006/0205827 A1 * 9/2006 Deroo et al. ..... 516/76
2008/0171680 A1 * 7/2008 Kim et al. ..... 508/491
2009/0111723 A1 * 4/2009 Shibata et al. ..... 508/463

FOREIGN PATENT DOCUMENTS

CN 101155901 4/2008
JP 4-118101 A 2/1993
TW 1269676 1/2007

OTHER PUBLICATIONS

The Written Opinion for International Patent Application No. PCT/US2010/034229, dated Jun. 24, 2010, 6 pages.
The Publication for International Patent Application No. PCT/US2010/034229, dated Nov. 11, 2010, 36 pages.
State Intellectual Property Office of People's Republic China, Search Report, CPCH1163290P, May 10, 2010.

* cited by examiner

SMALL PARTICLE SIZE OIL IN WATER LUBRICANT FLUID

CROSS-REFERENCE TO RELATED APPLICATIONS

This application is a National Stage Application of International Application No. PCT/US2010/034229, filed on May 10, 2010, which claims priority benefit from U.S. Provisional Patent Application No. 61/176,666 filed May 8, 2009, each of which are incorporated herein by reference in their entirety.

BACKGROUND

In cold rolling processes for steel, lubrication is an important and generally necessary component. Due to high speed, high pressure and high friction forces between a roll and a strip associated with the rolling processes, insufficient lubrication, insufficient cooling, and insufficient surface protection can occur, which can result in 1) an increase in roll force, 2) low strip reflectivity, 3) increased roll wear, and in some cases, 4) the inability to successfully roll the steel strip. Such negative effects can waste energy, consume rolls, result in poor product quality, and so on.

Traditionally, there have been primarily two types of lubricating modes for steel cold rolling processes: (1) lubrication with neat oils, and (2) lubrication with oil in water emulsions. Lubrication with neat oils has generally been eliminated because of issues with high flammability and insufficient cooling.

At present, the state of the art lubrication technology for cold rolling of steels involves lubrication using an emulsion with particle sizes greater than 1.0 μm, especially particle sizes greater than about 2.0 μm.

SUMMARY

According to some embodiments of the present invention, an oil in water lubricant fluid for use in steel cold rolling includes an oil in water emulsion having a particle size value of 1 μm or less. In some embodiments, an oil in water lubricant fluid for use in steel cold rolling includes an oil in water emulsion having particle size value of about 0.5 μm or less.

According to some embodiments of the present invention, an oil in water lubricant fluid for use in steel cold rolling includes an oil in water emulsion with an oil phase and a water phase. The oil phase may include about 5 wt % to about 40 wt % of at least one polymeric surfactant, about 25 wt % to about 95 wt % base oil; and about 0.2 wt % to about 10 wt % extreme pressure lubrication additives. In some embodiments, the emulsion includes oil phase particles having a particle size modal value, d(50%), of 1 μm or less. In some embodiments, the oil in water lubricant includes about 0.5 wt % to about 6 wt % functional additives in the oil phase. In some embodiments, the oil phase makes up about 0.5 wt % to about 15 wt % of the oil in water lubricant fluid.

In certain embodiments, the oil in water lubricant fluid includes at least one polymeric surfactant with an average molecular weight of about 1,000 to about 100,000. The polymeric surfactant may include a graft block polymer surfactant. In some embodiments, a polymeric surfactant includes hydrophobic blocks having a number average molecular weight at least about 200, or hydrophilic blocks having a number average molecular weight of at least about 200.

In some embodiments, base oil includes a natural ester, synthetic ester, mineral oil, or mixtures thereof. In certain embodiments, the extreme pressure lubrication additive is phosphorus based, sulfur based, or a mixture thereof.

In certain embodiments, at least about 50% of the oil phase is contained in particles with a size of less than 1 μm. In some embodiments, at least about 50% of the oil phase is contained in particles with a size of less than about 0.5 μm.

According to some embodiments, a method of cold rolling steel includes lubricating the steel with the oil in water lubricant fluid of the present invention.

DETAILED DESCRIPTION

Figure 1:
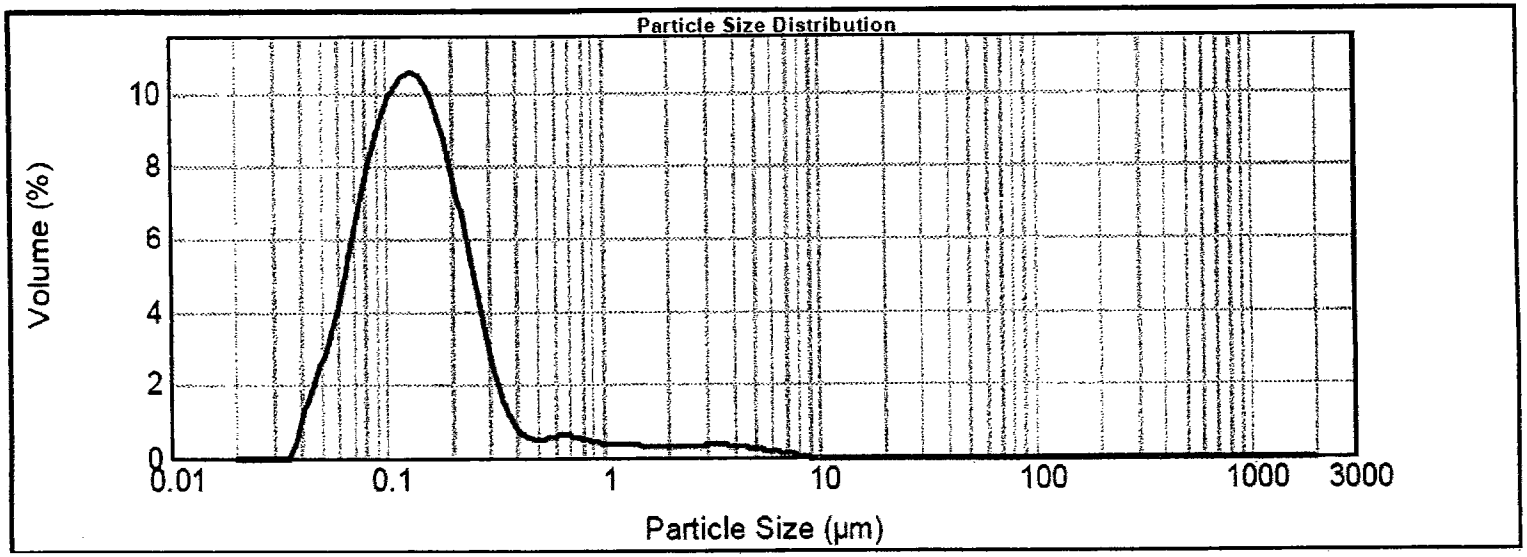
FIG. 1 shows a particle size distribution of a formulation about 0.13 μm.

Compositions and methods of some embodiments of the present invention relate to steel cold rolling processes with oil in water lubricants having a small particle size of less than or equal to 1 μm. As used herein, particle size (PSD) represents a modal value, d(50%), of the oil droplet diameter, based on a volume-weighted size distribution of oil droplets in the lubricant emulsion. The value of d(50%) is widely used in this field to express the particle size of emulsion. PSD≤1 μm may be understood to mean a volume weighted particle size distribution of which the volume weighted modus d(50%) is equal or smaller than 1 μm. Particle sizes described herein are measured with a Mastersizer 2000 (Malvern Instruments). The measurement is based on light diffraction.

In some embodiments, an emulsion contains a distribution of particle sizes around the mean particle size. Such processes and lubricant fluids may be suitable for any type of steel.

According to the traditional lubrication theory of steel cold rolling and the experience in the field, there exist two regimes of lubrication in the rolling process: boundary lubrication and elastic-hydrodynamic lubrication ("EHD"). Many steel rolling processes are conducted in the mixed lubrication regime, including characteristics of both boundary lubrication and EHD lubrication. Therefore in some embodiments it may be beneficial for a cold rolling lubricant fluid to demonstrate good boundary lubrication as well as good EHD lubrication. In some embodiments, oil in water lubricant fluids of the present invention possess sufficient lubrication properties in both boundary and EHD lubrication for use in cold rolling processes.

In addition to the lubrication requirement, some other technical requirements for a suitable lubricant used for the steel cold rolling should be considered, such as cooling ability, anti-rust ability, annealing ability, and so on.

Lubricant Fluid Composition

In some embodiments, an oil in water lubricant of the present invention includes: (A) an oil phase dispersed in (B) water. In some embodiments, the oil in water lubricant is a lubricant fluid.

A. Oil Phase

According to some embodiments, a lubricant includes an oil phase. In some embodiments, the oil phase can optionally include one or more of 1) about 5 wt % to about 40 wt % of one or more polymeric surfactants, 2) about 25 wt % to about 95 wt % of one or more base oils, 3) about 0.5 wt % to about 10 wt % of one or more extreme pressure ("EP") and/or anti-wear lubrication additives, and/or 4) about 1 wt % to about 6 wt % of one or more functional additives.

Polymeric Surfactants

An oil phase of an oil in water lubricant of some embodiments of the present invention includes one or more polymeric surfactants. Examples of suitable polymeric surfactants include but are not limited to polyvinylpyrrolidone, branched EO-PO block polymer and so on.

In some embodiments, suitable polymeric surfactants have an average molecular weight of about 1,000 to about 100,000; about 2,000 to about 80,000; or about 3,000 to about 70,000. In some embodiments, suitable polymeric surfactants have an average molecular weight of about 1,000; about 2,000; about 5,000; about 10,000; about 15,000; about 20,000; about 25,000; about 30,000; about 35,000; about 40,000; about 45,000; about 50,000; about 55,000; about 60,000 about 65,000; about 70,000; about 75,000; about 80,000; about 85,000; about 90,000; about 95,000; or about 100,000.

In some embodiments, polymer surfactants include graft block polymer surfactants. Graft block polymer surfactants may include, for example, hydrophobic blocks having a number average molecular weight of at least about 200. Graft block polymer surfactants may include, for example, hydrophilic blocks having a number average molecular weight of at least about 200, in some embodiments having a number average molecular weight of at least about 300 to about 5000, and in some embodiments having a number average molecular weight of about 400 to about 1000.

In some embodiments, an oil phase of an oil in water lubricant includes one or more polymeric surfactants in an amount of about 5 wt % to about 40 wt %; about 10 wt % to about 35 wt %; or about 15 wt % to about 30 wt %. In some embodiments, an oil phase of an oil in water lubricant includes one or more polymeric surfactants in an amount of about 5 wt %; about 6 wt %; about 7 wt %; about 8 wt %; about 9 wt %; about 10 wt %; about 11 wt %; about 12 wt %; about 13 wt %; about 14 wt %; about 15 wt %; about 16 wt %; about 17 wt %; about 18 wt %; about 19 wt %; about 20 wt %; about 21 wt %; about 22 wt %; about 23 wt %; about 24 wt %; about 25 wt %; about 26 wt %; about 27 wt %; about 28 wt %; about 29 wt %; about 30 wt %; about 31 wt %; about 32 wt %; about 33 wt %; about 34 wt %; about 35 wt %; about 36 wt %; about 37 wt %; about 38 wt %; about 39 wt %; or about 40 wt %.

Base Oil

An oil phase of an oil in water lubricant of some embodiments of the present invention includes one or more base oils. Examples of suitable base oils include but are not limited to natural esters, synthetic esters, mineral oils, or combinations or mixtures thereof. In some embodiments, a suitable base oil includes palm oil.

In some embodiments, an oil phase of an oil in water lubricant of the present invention includes one or more base oils in an amount of about 25 wt % to about 95 wt %; about 25 wt % to about 93 wt %; about 50 wt % to about 93 wt %; about 40 wt % to about 80 wt %; about 50 wt % to about 70 wt %; about 56 wt % to about 70 wt %; about 60 wt % to about 66 wt %; about 60 wt % to about 95 wt %; about 60 to about 93 wt %; about 65 wt % to about 85 wt %; about 70 wt % to about 85 wt %; about 75 wt % to about 80 wt %; about 25 wt % to about 55 wt %; about 30 wt % to about 50 wt %; about 35 wt % to about 45 wt %; or about 38 wt % to about 44 wt %. In some embodiments, an oil phase of an oil in water lubricant of the present invention includes one or more base oils in an amount of about 25 wt %; about 30 wt %; about 35 wt %; about 40 wt %; about 45 wt %; about 50 wt %; about 55 wt %; about 60 wt %; about 65 wt %; about 70 wt %; about 75 wt %; about 80 wt %; about 85 wt %; about 90 wt %; or about 95 wt %.

Extreme Pressure and/or Anti-Wear Lubrication Additives

An oil phase of an oil in water lubricant of some embodiments of the present invention includes one or more extreme pressure ("EP") and/or anti-wear lubrication additives. Examples of suitable EP and/or anti-wear lubrication additives include but are not limited to amine phosphates, non-ethoxylated phosphate esters, ethoxylated phosphate esters, alkyl acidy phosphate, sulphurized fatty esters, and alkyl polysulphides. In some embodiments, suitable EP and anti-wear lubrication additives are phosphorus based, sulfur based, and/or a mixture thereof.

In some embodiments, an oil phase of an oil in water lubricant includes one or more EP and/or anti-wear lubrication additives in an amount of about 0.2 wt % to about 10 wt %; about 0.5 wt % to about 10 wt %; 1 wt % to about 9 wt %; about 2 wt % to about 8 wt %; about 3 wt % to about 7 wt %; or about 4 wt % to about 6 wt %. In some embodiments, an oil phase of an oil in water lubricant includes one or more EP and/or anti-wear lubrication additives in an amount of about 0.2 wt %; about 0.5 wt %; about 1 wt %; about 1.5 wt %; about 2 wt %; about 2.5 wt %; about 3 wt %; about 3.5 wt %; about 4 wt %; about 4.5 wt %; about 5 wt %; about 5.5 wt %; about 6 wt %; about 6.5 wt %; about 7 wt %; about 7.5 wt %; about 8 wt %; about 8.5 wt %; about 9 wt %; about 9.5 wt %; or about 10 wt %.

Functional Additives

An oil phase of an oil in water lubricant of some embodiments of the present invention includes one or more functional additives. Any suitable functional additives may be included to achieve the desired result. Such additives may be chosen in order to cover boundary lubrication and other process requirements of steel cold rolling. Examples of suitable additives include but are not limited to anti-rust additives, anti-foam additives, antioxidant additives, emulsifiers, thickeners, wetting additives, and the like. An example of a suitable corrosion inhibitor additive includes but is not limited to tolutriazole. An example of a suitable antioxidant additive includes but is not limited to alkylated amino phenol. An example of a suitable wetting additive includes but is not limited to branched fatty acids.

In some embodiments, an oil phase of an oil in water lubricant includes one or more functional additives in an amount of about 0.5 wt % to about 10 wt %; about 1 wt % to about 8 wt %; about 1 wt % to about 6 wt %; or about 1 wt % to about 4 wt %.

B. Oil in Water Dispersion

Oil in water lubricants of some embodiments of the present invention may be prepared by dispersing an oil phase described above into water. In some embodiments, an oil in water lubricant fluid is prepared by pump circulation. In some embodiments, a lubricant fluid includes the oil phase dispersed in water in an amount of about 0.5 wt % to about 15 wt % of the oil in water lubricant fluid; about 1 wt % to about 15 wt % of the oil in water lubricant fluid; about 1 wt % to about 10 wt % of the lubricant fluid; about 1 wt % to about 7 wt % of the lubricant fluid; of about 1 wt % to about 5 wt % of the lubricant fluid. In some embodiments, a lubricant fluid his an oil phase dispersed in water in an amount of about 0.5 wt % of the lubricant fluid; about 1 wt % of the lubricant fluid; about 2 wt % of the lubricant fluid; about 3 wt % of the lubricant fluid; about 4 wt % of the lubricant fluid; about 5 wt % of the lubricant fluid; about 6 wt % of the lubricant fluid; about 7 wt % of the lubricant fluid; about 8 wt % of the lubricant fluid; about 9 wt % of the lubricant fluid; or about 10 wt % of the lubricant fluid.

An oil in water lubricant fluid may contain oil phase droplets, or particles. In some embodiments, an oil in water lubricant fluid may contain oil phase particles having a particle size (PSD) representing a modus or modal value, d(50%), based on a volume-weighted size distribution of oil droplets in the lubricant emulsion. In some embodiments, an oil in water lubricant fluid contains a distribution of particle sizes about the particle size modal value d(50%). In some embodiments, a particle size distribution of an oil in water lubricant fluid is dependant upon the type of emulsifiers and/or the concentration thereof.

In some embodiments, the concentration of polymeric surfactant can be used to prepare small particle size oil in water emulsions as a result of low static interfacial tension. It is believed that as a result of the concentration of a polymeric surfactant as taught herein, the oil in water lubricant can have the performance of small particle sizes (PSD≤1 μm or PSD≤0.5 μm), including enhanced stability and less residue oil plate out on the rolled metal, and yet still maintain a sufficiently thick film formation compared with a traditional particle size emulsion (PSD>1 μm).

In some embodiments, about 96% v/v of the oil phase is contained in particles with a size of less than 1.0 μm. In some embodiments, at least about 94% v/v of the oil phase is contained in particles with a size of less than about 0.5 μm. In some embodiments, at least about 75% v/v of the oil phase in an oil in water lubricant fluid is contained in particles with a size of less than about 0.20 μm. In some embodiments, at least about 50% v/v of the oil phase of an oil in water lubricant fluid is contained in particles with a size of less than about 0.13 μm.

In some embodiments, an oil in water lubricant has a particle size modal value d(50%) of less than or equal to 1.0 μm; less than or equal to about 0.9 μm; less than or equal to about 0.8 μm; less than or equal to about 0.7 μm; less than or equal to about 0.6 μm; less than or equal to about 0.5 μm; less than or equal to about 0.4 μm; less than or equal to about 0.3 μm; less than or equal to about 0.2 μm; less than or equal to about 0.1 μm; less than or equal to about 0.09 μm; less than or equal to about 0.08 μm; less than or equal to about 0.07 μm; less than or equal to about 0.06 μm; or less than or equal to about 0.05 μm. In some embodiments, an oil in water lubricant fluid has a particle size modal value d(50%) of about 0.05 μm to 1 μm; about 0.05μm to about 0.9 μm; about 0.05 μm to about 0.8 μm; about 0.05 μm to about 0.7 μm; about 0.05 μm to about 0.6 μm; about 0.05 μm to about 0.5 μm; about 0.05 μm to about 0.4 μm; about 0.05 μm to about 0.3 μm; about 0.05 μm to about 0.2 μm; about 0.1 μm to 1 μm; about 0.1 μm to about 0.9 μm; about 0.1 μm to about 0.8 μm; about 0.1 μm to about 0.7 μm; about 0.1 μm to about 0.6 μm; about 0.1 μm to about 0.5 μm; about 0.1 μm to about 0.4 μm; about 0.1 μm to about 0.3 μm; about 0.1 μm to about 0.2 μm. In some embodiments, an oil in water lubricant has a particle size modal value d(50%) of about 0.05 μm; about 0.06 μm; about 0.07 μm; about 0.08 μm; about 0.09 μm; about 0.1 μm; about 0.11 μm; about 0.12 μm; about 0.13 μm; about 0.14 μm; about 0.15 μm; about 0.16 μm; about 0.17 μm; about 0.18 μm; about 0.19 μm; about 0.2 μm; about 0.21 μm; about 0.22 μm; about 0.23 μm; about 0.24 μm; about 0.25 μm; about 0.26 μm; about 0.27 μm; about 0.28 μm; about 0.29 μm; about 0.3 μm; about 0.31 μm; about 0.32 μm; about 0.33 μm; about 0.34 μm; about 0.35 μm; about 0.36 μm; about 0.37 μm; about 0.38 μm; about 0.39 μm; about 0.4 μm; about 0.41 μm; about 0.42 μm; about 0.43 μm; about 0.44 μm; about 0.45 μm; about 0.46 μm; about 0.47 μm; about 0.48 μm; about 0.49 μm; about 0.5 μm; about 0.55 μm; about 0.6 μm; about 0.65 μm; about 0.7 μm; about 0.75 μm; about 0.8 μm; about 0.85 μm; about 0.9 μm; about 0.95 μm; or about 1 μm.

Method of Cold Rolling Steel

In some embodiments, a method of cold rolling steel includes cold rolling steel while lubricating the steel with an oil in water lubricant as described herein. In some embodiments, a method of cold rolling steel includes cold rolling steel while lubricating the steel with an oil in water lubricant having a particle size of less than 1 μm. In some embodiments, a method of cold rolling steel includes cold rolling steel while lubricating the steel with an oil in water lubricant having a particle size of less than or equal to about 0.5 μm. Methods of some embodiments of the present invention may be advantageous over cold rolling steel using traditional emulsions, such as those having particle size diameters ("PSD") greater than 1 μm or greater than 2 μm, because oil in water lubricant fluids of the present invention can provide high stability, less residue oil "plate out" on the rolled metal surface, comparable or improved film thickness, comparable anti-staining properties, and/or improved cooling ability during cold rolling steel. "Plate out" of an emulsion may be defined as a quantity that is used to describe the ability of the oil phase to adsorb on the rolled metal surface; or the amount of oil left on a steel strip after spraying with an emulsion.

In order to make an oil emulsifiable, monomeric surfactants are traditionally applied in combination with relatively low amounts of polymeric surfactant. Such a combination may result in an emulsion with small particles but a lubricity level which is insufficiently low for rolling. While not wishing to be bound by theory, it is believed that generally, small particle size emulsions made with monomeric surfactants and low amounts of polymeric surfactant cannot form a significantly thick film due to a too low interfacial tension compared with the interfacial tension demonstrated by traditional emulsions having a particle size greater than 1 μm. Surprisingly, lubricant fluids of some embodiments of the present invention which include oil in water emulsions prepared using a polymeric surfactant and having a small particle size (PSD≤1 μm or PSD≤0.5 μm), resulted in even thicker film compared with traditional emulsion (PSD>1 μm). The film formation of an emulsion may be related to the interfacial tension of the fluid in the inlet; in some embodiments, a lower interfacial tension results in a lower film thickness. In a steel cold rolling process, an emulsion of the invention may be quickly sprayed into the rollers. It is believed that in some embodiments, a branched polymeric surfactant with slow dynamic surface tension properties provides under these dynamic circumstances a high interfacial tension leading to thick films.

As used herein, the term "about" is understood to mean ±10% of the value referenced. For example, "about 0.8" is understood to literally mean 0.72 to 0.88.

EXAMPLES

Small particle size oil in water lubricant fluid packages were evaluated using an array of experiments which are considered in the industry to be highly predictive of the performance of a lubricant package when applied in a steel cold rolling process, including:

(a) Intrinsic lubrication properties evaluated with SODA and Falex lubrication tests;

(b) EP/anti-wear properties evaluated with 4-ball test;

(c) Lubricant film forming properties of small PSD oil in water lubricant packages evaluated under high speed high pressure EHD contacts with a nanometer optic interferometer EHD rig;

(d) The property of plating out an oil layer on sheet surfaces when an emulsion is sprayed with a high pressure on the surfaces resembling the coolant sprays normally and commonly used in a steel cold rolling mill;

(e) Thermal stability and evaporation properties were tested with thermo gravimetric analysis TGA equipment;

(g) Rolling performance characteristics were tested on a 4-high reversing rolling test mill with a test procedure correlating to the various production mill processes, tandem or reversing.

The following examples are provided merely for the purpose of describing some lubricant compositions representative of the present invention in greater detail, and are in no way to be considered as setting a limitation on the scope of the invention.

Formulations

Three formulations were prepared for use in the Examples:

Formulation 1:

The composition of the oil phase is as follows:

| | |
|---|---|
| Palm oil: | 63.05 wt. % |
| Branched polymeric surfactant (MW: 3000-70,000): | 30.00 wt. % |
| P donor 1: | 0.50 wt. % |
| P donor 2: | 0.40 wt. % |
| S donor 1: | 4.75 wt. % |
| Tolutriazole: | 0.10 wt. % |
| Alkylated Amino phenol: | 0.20 wt. % |
| Branched Fatty acid: | 1.00 wt. % |
| Total: | 100.00 wt. % |

3 wt. % above oil phase was dispersed into water.
PSD: 0.13 μm

Formulation 1 PSD about 0.13 μm is shown in FIG. 1 and the data of Table 1, below:

TABLE 1

| The PSD of Formulation 1 with PSD 0.13 μm | |
|---|---|
| Size (μm) | Vol Under % |
| 0.020 | 0.00 |
| 0.022 | 0.00 |
| 0.025 | 0.00 |
| 0.028 | 0.00 |
| 0.032 | 0.00 |
| 0.036 | 0.00 |
| 0.040 | 0.23 |
| 0.045 | 1.24 |
| 0.050 | 2.83 |
| 0.056 | 5.13 |
| 0.063 | 8.21 |
| 0.071 | 12.33 |
| 0.080 | 17.52 |
| 0.089 | 23.67 |
| 0.100 | 30.61 |
| 0.112 | 38.13 |
| 0.126 | 45.98 |
| 0.142 | 53.92 |
| 0.159 | 61.65 |
| 0.178 | 68.88 |
| 0.200 | 75.37 |
| 0.224 | 80.85 |
| 0.252 | 85.22 |
| 0.283 | 88.42 |
| 0.317 | 90.59 |
| 0.356 | 91.93 |
| 0.399 | 92.74 |
| 0.448 | 93.25 |
| 0.502 | 93.64 |
| 0.564 | 94.04 |
| 0.632 | 94.49 |
| 0.710 | 94.97 |
| 0.796 | 95.40 |
| 0.893 | 95.77 |
| 1.002 | 96.09 |
| 1.125 | 96.37 |
| 1.262 | 96.65 |
| 1.416 | 96.92 |
| 1.589 | 97.17 |
| 1.783 | 97.41 |
| 2.000 | 97.64 |
| 2.244 | 97.86 |
| 2.518 | 98.09 |
| 2.825 | 98.33 |
| 3.170 | 98.59 |
| 3.557 | 98.85 |
| 3.991 | 99.10 |
| 4.477 | 99.33 |
| 5.024 | 99.53 |
| 5.637 | 99.69 |
| 6.325 | 99.81 |
| 7.096 | 99.91 |
| 7.962 | 99.98 |
| 8.934 | 100.00 |
| 10.024 | 100.00 |
| 11.247 | 100.00 |
| 12.619 | 100.00 |
| 14.159 | 100.00 |
| 15.887 | 100.00 |
| 17.825 | 100.00 |
| 20.000 | 100.00 |
| 22.440 | 100.00 |
| 25.179 | 100.00 |
| 28.251 | 100.00 |
| 31.698 | 100.00 |
| 35.566 | 100.00 |
| 39.905 | 100.00 |
| 44.774 | 100.00 |
| 50.238 | 100.00 |
| 56.368 | 100.00 |
| 63.246 | 100.00 |
| 70.963 | 100.00 |
| 79.621 | 100.00 |
| 89.337 | 100.00 |
| 100.237 | 100.00 |
| 112.468 | 100.00 |
| 126.191 | 100.00 |
| 141.589 | 100.00 |

TABLE 1-continued

| The PSD of Formulation 1 with PSD 0.13 μm | |
|---|---|
| Size (μm) | Vol Under % |
| 158.666 | 100.00 |
| 178.250 | 100.00 |
| 200.000 | 100.00 |
| 224.404 | 100.00 |
| 251.785 | 100.00 |
| 282.508 | 100.00 |
| 316.979 | 100.00 |
| 355.656 | 100.00 |
| 399.052 | 100.00 |
| 447.744 | 100.00 |
| 502.377 | 100.00 |
| 563.677 | 100.00 |
| 632.456 | 100.00 |
| 709.627 | 100.00 |
| 796.214 | 100.00 |
| 893.367 | 100.00 |
| 1002.374 | 100.00 |
| 1124.683 | 100.00 |
| 1261.915 | 100.00 |
| 1415.892 | 100.00 |
| 1588.656 | 100.00 |
| 1782.502 | 100.00 |
| 2000.000 | 100.00 |

Formulation 2:

The composition of the oil phase is as follows:

| | |
|---|---|
| Palm oil: | 78.05 wt. % |
| Branched polymeric surfactant (MW: 3000-70000): | 15.00 wt. % |
| P donor 1: | 0.50 wt. % |
| P donor 2: | 0.40 wt. % |
| S donor 1: | 4.75 wt. % |
| Tolutriazole: | 0.10 wt. % |
| Alkylated Amino phenol: | 0.20 wt. % |
| Branched fatty acid: | 1.00 wt. % |
| Total: | 100.00 wt. % |

3 wt. % above oil phase was dispersed into water.
PSD: 0.45 μm

Figure 2:
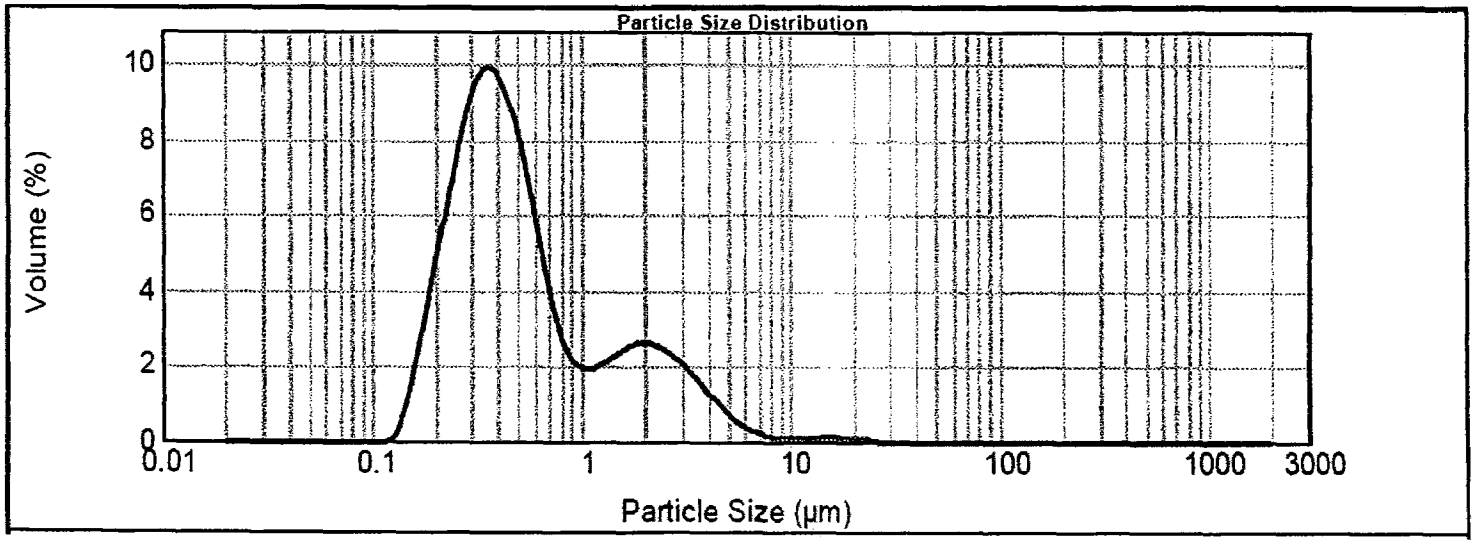
FIG. 2 shows a particle size distribution of a formulation about 0.45 μm.

Formulation 2 PSD about 0.45 μm is shown in FIG. 2 and the data of Table 2, below:

TABLE 2

| The PSD of Formulation 2 with PSD d (50%) 0.45 μm | |
|---|---|
| Size (μm) | Vol Under % |
| 0.020 | 0.00 |
| 0.022 | 0.00 |
| 0.025 | 0.00 |
| 0.028 | 0.00 |
| 0.032 | 0.00 |
| 0.036 | 0.00 |
| 0.040 | 0.00 |
| 0.045 | 0.00 |
| 0.050 | 0.00 |
| 0.056 | 0.00 |
| 0.063 | 0.00 |
| 0.071 | 0.00 |
| 0.080 | 0.00 |
| 0.089 | 0.00 |
| 0.100 | 0.00 |
| 0.112 | 0.00 |
| 0.126 | 0.01 |
| 0.142 | 0.30 |
| 0.159 | 1.32 |
| 0.178 | 3.23 |
| 0.200 | 6.15 |
| 0.224 | 10.19 |

TABLE 2-continued

| The PSD of Formulation 2 with PSD d (50%) 0.45 μm | |
|---|---|
| Size (μm) | Vol Under % |
| 0.252 | 15.34 |
| 0.283 | 21.50 |
| 0.317 | 38.42 |
| 0.356 | 35.80 |
| 0.399 | 43.25 |
| 0.448 | 50.39 |
| 0.502 | 56.91 |
| 0.564 | 62.54 |
| 0.632 | 67.10 |
| 0.710 | 70.61 |
| 0.796 | 73.19 |
| 0.893 | 75.11 |
| 1.002 | 76.66 |
| 1.125 | 78.11 |
| 1.262 | 79.61 |
| 1.416 | 81.23 |
| 1.589 | 82.99 |
| 1.783 | 84.89 |
| 2.000 | 86.86 |
| 2.244 | 88.82 |
| 2.518 | 90.70 |
| 2.825 | 92.46 |
| 3.170 | 94.03 |
| 3.557 | 95.41 |
| 3.991 | 96.54 |
| 4.477 | 97.43 |
| 5.024 | 98.08 |
| 5.637 | 98.54 |
| 6.325 | 98.85 |
| 7.096 | 99.06 |
| 7.962 | 99.20 |
| 8.934 | 99.28 |
| 10.024 | 99.35 |
| 11.247 | 99.43 |
| 12.619 | 99.51 |
| 14.159 | 99.60 |
| 15.887 | 99.69 |
| 17.825 | 99.79 |
| 20.000 | 99.88 |
| 22.440 | 99.95 |
| 25.179 | 100.00 |
| 28.251 | 100.00 |
| 31.698 | 100.00 |
| 35.568 | 100.00 |
| 39.905 | 100.00 |
| 44.774 | 100.00 |
| 50.238 | 100.00 |
| 56.368 | 100.00 |
| 63.246 | 100.00 |
| 70.963 | 100.00 |
| 79.621 | 100.00 |
| 69.337 | 100.00 |
| 100.237 | 100.00 |
| 112.468 | 100.00 |
| 126.191 | 100.00 |
| 141.589 | 100.00 |
| 158.666 | 100.00 |
| 178.250 | 100.00 |
| 200.000 | 100.00 |
| 224.404 | 100.00 |
| 251.785 | 100.00 |
| 282.508 | 100.00 |
| 316.979 | 100.00 |
| 355.656 | 100.00 |
| 399.052 | 100.00 |
| 447.744 | 100.00 |
| 502.377 | 100.00 |
| 563.677 | 100.00 |
| 632.456 | 100.00 |
| 709.627 | 100.00 |
| 796.214 | 100.00 |
| 893.367 | 100.00 |
| 1002.374 | 100.00 |
| 1124.683 | 100.00 |
| 1261.915 | 100.00 |
| 1415.892 | 100.00 |

TABLE 2-continued

| The PSD of Formulation 2 with PSD d (50%) 0.45 μm | |
|---|---|
| Size (μm) | Vol Under % |
| 1588.656 | 100.00 |
| 1782.502 | 100.00 |
| 2000.000 | 100.00 |

Formulation 3:

The composition of the oil phase is as follows:

| | |
|---|---|
| Palm oil: | 41.50 wt. % |
| Branched polymeric surfactant (MW: 3000-70000): | 30.00 wt. % |
| PE ester | 15.00 wt. % |
| Polybutene | 3.50 wt. % |
| Fatty acid | 2.25 wt. % |
| P donor 1: | 0.50 wt. % |
| S donor 1: | 3.00 wt. % |
| S donor 2: | 1.00 wt. % |
| Benzotriazole: | 0.25 wt. % |
| Alkylated Amino phenol: | 0.75 wt. % |
| P donor 2: | 1.25 wt. % |
| PE complex ester: | 1.00 wt. % |
| Total: | 100.00 wt. % |

3 wt. % above oil phase was dispersed into water.
PSD: 0.17 μm

Figure 3:
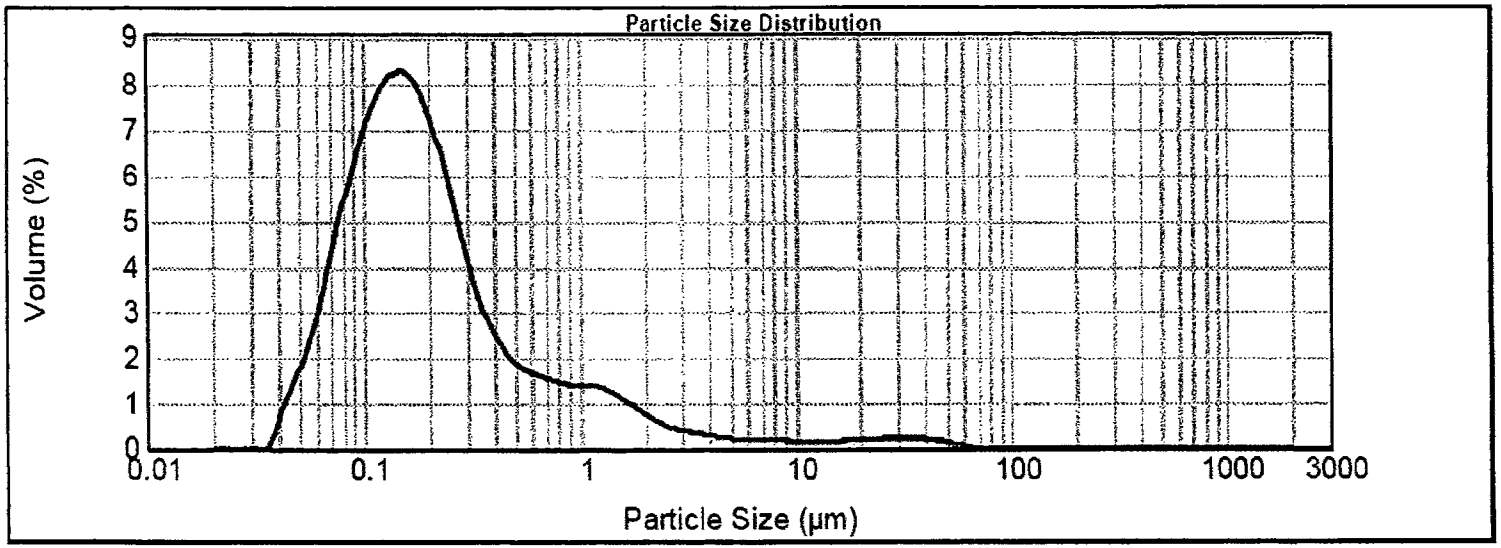
FIG. 3 shows a particle size distribution of a formulation about 0.17 μm.

Formulation 3 PSD about 0.17 μm is shown in FIG. 3 and the data of Table 3, below:

TABLE 3

| The PSD of formulation 3 with PSD d (50%) 0.17 μm | |
|---|---|
| Size (μm) | Vol Under % |
| 0.020 | 0.00 |
| 0.022 | 0.00 |
| 0.025 | 0.00 |
| 0.028 | 0.00 |
| 0.032 | 0.00 |
| 0.036 | 0.00 |
| 0.040 | 0.11 |
| 0.045 | 0.79 |
| 0.050 | 1.85 |
| 0.056 | 3.40 |
| 0.063 | 5.49 |
| 0.071 | 8.29 |
| 0.080 | 11.87 |
| 0.089 | 16.17 |
| 0.100 | 21.12 |
| 0.112 | 26.61 |
| 0.126 | 32.51 |
| 0.142 | 38.66 |
| 0.159 | 44.90 |
| 0.178 | 51.04 |
| 0.200 | 56.87 |
| 0.224 | 62.21 |
| 0.252 | 66.91 |
| 0.283 | 70.87 |
| 0.317 | 74.13 |
| 0.356 | 76.75 |
| 0.399 | 78.89 |
| 0.448 | 80.67 |
| 0.502 | 82.20 |
| 0.564 | 83.57 |
| 0.632 | 84.85 |
| 0.710 | 86.05 |
| 0.796 | 87.19 |
| 0.893 | 88.28 |
| 1.002 | 89.34 |
| 1.125 | 90.40 |
| 1.262 | 91.45 |
| 1.416 | 92.44 |

TABLE 3-continued

| The PSD of formulation 3 with PSD d (50%) 0.17 μm | |
|---|---|
| Size (μm) | Vol Under % |
| 1.589 | 93.33 |
| 1.783 | 94.10 |
| 2.000 | 94.74 |
| 2.244 | 95.27 |
| 2.518 | 95.69 |
| 2.825 | 96.04 |
| 3.170 | 96.34 |
| 3.557 | 96.61 |
| 3.991 | 96.85 |
| 4.477 | 97.06 |
| 5.024 | 97.23 |
| 5.637 | 97.38 |
| 6.325 | 97.53 |
| 7.096 | 97.67 |
| 7.962 | 97.82 |
| 8.934 | 97.94 |
| 10.024 | 98.06 |
| 11.247 | 98.18 |
| 12.619 | 98.28 |
| 14.159 | 98.39 |
| 15.887 | 98.51 |
| 17.825 | 98.63 |
| 20.000 | 98.76 |
| 22.440 | 98.90 |
| 25.179 | 99.05 |
| 28.251 | 99.21 |
| 31.698 | 99.36 |
| 35.566 | 99.52 |
| 39.905 | 99.66 |
| 44.774 | 99.79 |
| 50.238 | 99.90 |
| 56.368 | 99.97 |
| 63.246 | 100.00 |
| 70.963 | 100.00 |
| 79.621 | 100.00 |
| 89.337 | 100.00 |
| 100.237 | 100.00 |
| 112.468 | 100.00 |
| 126.191 | 100.00 |
| 141.589 | 100.00 |
| 158.866 | 100.00 |
| 178.250 | 100.00 |
| 200.000 | 100.00 |
| 224.404 | 100.00 |
| 251.785 | 100.00 |
| 282.508 | 100.00 |
| 316.979 | 100.00 |
| 355.656 | 100.00 |
| 399.052 | 100.00 |
| 447.744 | 100.00 |
| 502.377 | 100.00 |
| 563.677 | 100.00 |
| 632.456 | 100.00 |
| 709.627 | 100.00 |
| 796.214 | 100.00 |
| 893.367 | 100.00 |
| 1002.374 | 100.00 |
| 1124.683 | 100.00 |
| 1261.915 | 100.00 |
| 1415.892 | 100.00 |
| 1588.656 | 100.00 |
| 1782.502 | 100.00 |
| 2000.000 | 100.00 |

Example 1

Boundary Lubrication

The intrinsic lubrication properties of the small particle size (PSD≤1 μm or PSD≤0.5 μm) oil in water lubricant fluid package were evaluated by using SODA and Falex tests with prescribed test procedures commonly used for evaluating lubrication properties of lubricants for use in steel cold rolling. Three conventional emulsion (PSD≥2 μm) lubricant packages, widely used in multiple production 4-stand 4-high and/or 5-stand 6-high tandem mills and/or 6-high high speed reversing mills with good performance results were used as the comparison references (referred to hereinafter as oil 1, oil 2 and oil 3 respectively).

SODA (50 C): Oils and small PSD products are all tested neat (=100%).

| | Oil 1 | Oil 2 | Oil 3 | Formulation 1 | Formulation 2 | Formulation 3 |
|---|---|---|---|---|---|---|
| CoF* | 0.11 | 0.11 | 0.11 | 0.11 | 0.11 | 0.10 |

*CoF: coefficient of friction

A majority of lubricating oils used in production mill have coefficients of friction about 0.10-0.15 in Soda (50° C.). Formulation 1-3 fall within this standard range.

Falex: Oils and small PSD products are all neat (=100%).

| | Oil 1 | Oil 2 | Oil 3 | Formulation 1 | Formulation 2 | Formulation 3 |
|---|---|---|---|---|---|---|
| Failure load (lbs) | 1500 | 1750 | 2000 | 2500 | 2500 | 2500 |
| Torque (lb-in) | 31.8 | 31.0 | 32.7 | 34.4 | 34.1 | 31.6 |

From the test results shown above, all small particle size (PSD≤1 μm or PSD≤0.5 μm) oil in water lubricant fluid packages give better or comparable intrinsic lubrication properties as compared to the three References. Formulations 1-3 fall within the standard range.

Example 2

Extreme Pressure

Oils and small PSD products are all tested neat (=100%).

The EP lubrication properties of the small particle size (PSD≤1 μm or PSD≤0.5 μm) oil in water lubricant fluid packages were evaluated by using 4-ball tests with prescribed test procedures commonly used for evaluating lubrication properties of lubricants for use in steel cold rolling. Again, the three References were used for comparison purposes. The break load results are included in the following table:

| Extreme pressure ($P_B$) results | | | | | | |
|---|---|---|---|---|---|---|
| | Oil 1 | Oil 2 | Oil 3 | Formulation 1 | Formulation 2 | Formulation 3 |
| $P_B$ (N) | 1167 | 932 | 1363 | 1961 | 1961 | 1961 |

A majority of lubricating oils used in production mill have break loads above 600N in 4-ball. A cold rolling product generally has a break load of about 600N or higher. Formulations 1-3 fall within this standard range.

Example 3

Film Thickness

Oils and small PSD products are tested at 3 wt %.

The film forming properties of small particle size (PSD≤11 μm or PSD≤0.5 μm) oil in water lubricant fluid under high speed high pressure EHD contacts were evaluated by using an optical interference rig (interferometer) with prescribed test procedures commonly used for evaluating film forming properties of lubricants for use in steel cold rolling. References oil 1 and 2 were used for comparison purposes.

Figure 4:
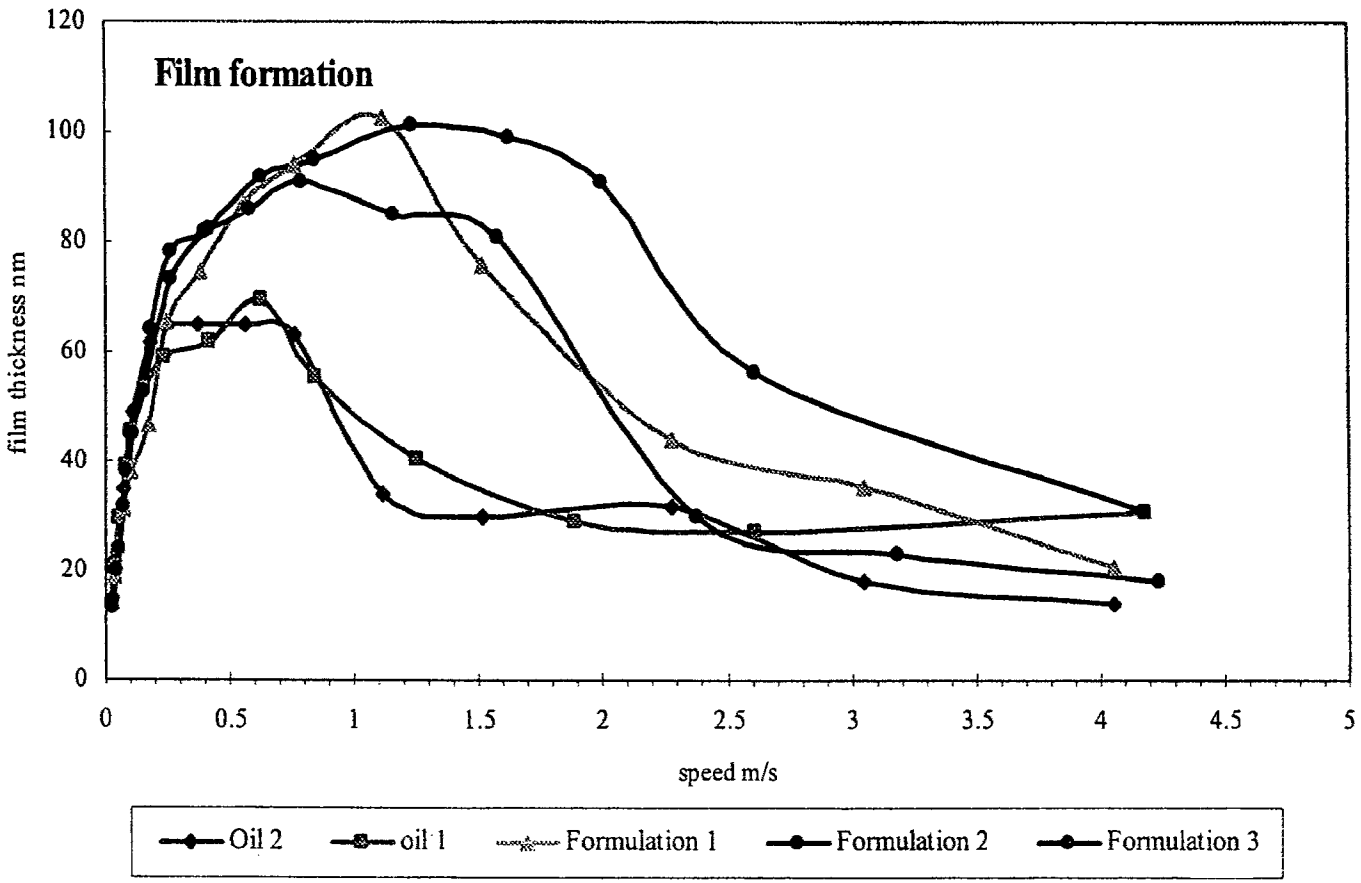
FIG. 4 shows film formation results for various formulations and references oils.

Film formation results for Formulations 1-3 and Oils 1-2 can be seen in FIG. 4. The 3% emulsion films of formulation 1 to 3 are thicker than those of a 3% emulsion of oil 1 and oil 2 under the same conditions. These results show that the small particle size (PSD≤1 μm or PSD≤0.5 μm) oil in water lubricant fluid can form even thicker film than normal particle size emulsions.

Example 4

Plate Out Values

Oils and small PSD products are tested at 3 wt %.

The "plate out" of an emulsion is a quantity that is used to describe the ability of oil to adsorb on the steel surface. The emulsions were evaluated by using a high pressure spray system with prescribed test procedures. Three typical oil products used in production mills (oil 1, oil 2 and oil 3 as described above) are selected as references for comparison. The plate out results of 3% emulsions are shown below:

| The plate out results | | | | | | |
|---|---|---|---|---|---|---|
| | Oil 1 | Oil 2 | Oil 3 | Formulation 1 | Formulation 2 | Formulation 3 |
| Plate out ($mg/m^2$) | 856 | 654 | 350 | 175 | 221 | 89 |

The plate out values of small PSD oil in water lubricant fluids of Formulation 1 to 3 are lower than those of normal PSD emulsion of oil 1 and oil 2. The small PSD oil in water lubricant fluids of Formulation 1 to 3 are expected to have lower oil consumption, better cooling ability and easier annealing because of the lower amount of oil residue on the strip.

Example 5

Stack Staining

Oils and small PSD products are tested at 3 wt %.

Figure 5:
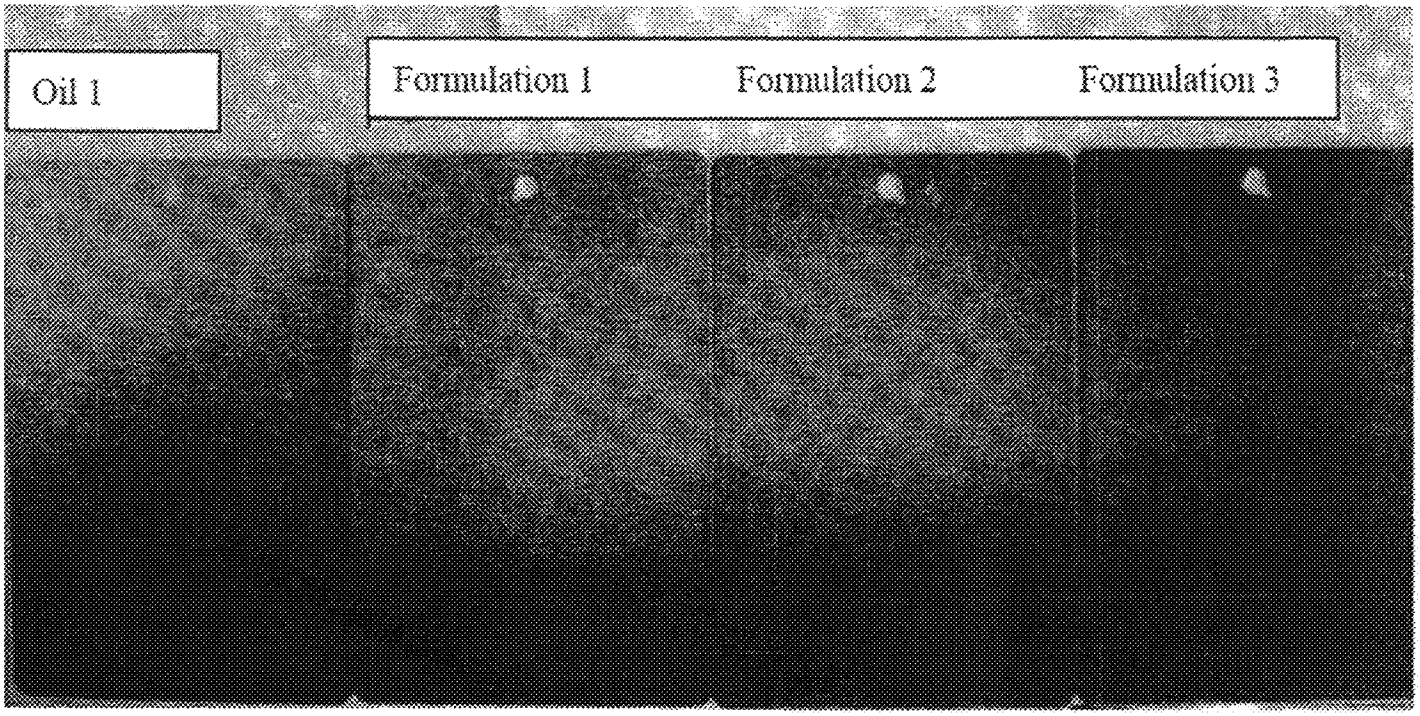
FIG. 5 shows stack staining test results for various formulations and an oil.

Anti-staining properties of the small particle size (PSD≤1 μm or PSD≤0.5 μm) oil in water lubricant fluid package were evaluated by stack staining tests. Reference oil 1 was used for comparison purposes. The results are shown in FIG. 5, and demonstrate that the anti-staining properties of Formulation 1 to 3 are comparable to those of oil 1.

Example 6

TGA

Oils and small PSD products are all tested neat (=100%).

Thermal stability and evaporation properties were evaluated with thermo gravimetric analysis (TGA) equipment. A typical oil used in a production mill, oil 1, is selected again as reference oil. The TGA results are included in the following table:

| TGA results | | | |
|---|---|---|---|
| Peak Maximum | | | |
| | Start (° C.) | Stop (° C.) | Maximum (° C.) |

-continued

| TGA results | | | |
|---|---|---|---|
| Oil 1 | 287.75 | 496.12 | 405.93 |
| Formula 1 | 280.69 | 481.11 | 405.57 |

| Residue | | | |
|---|---|---|---|
| | Temperature (° C.) | Weight (mg) | Weight (%) |
| Oil 1 | 636.76 | 0.0424 | 0.482 |
| Formula 1 | 636.73 | 0.0146 | 0.1648 |

Figure 6:
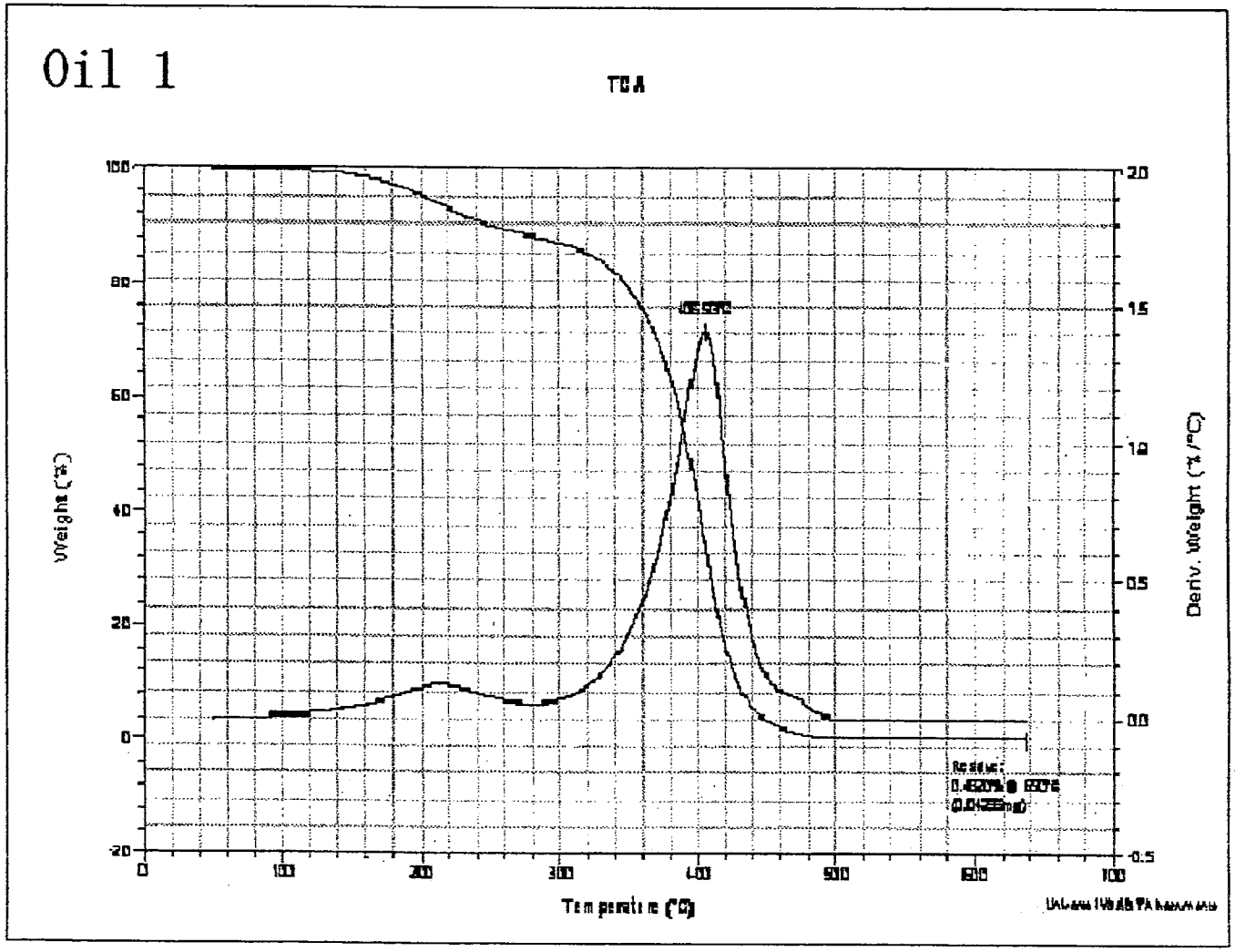
FIG. 6 shows thermo gravimetric analysis results for a reference oil.
Figure 7:
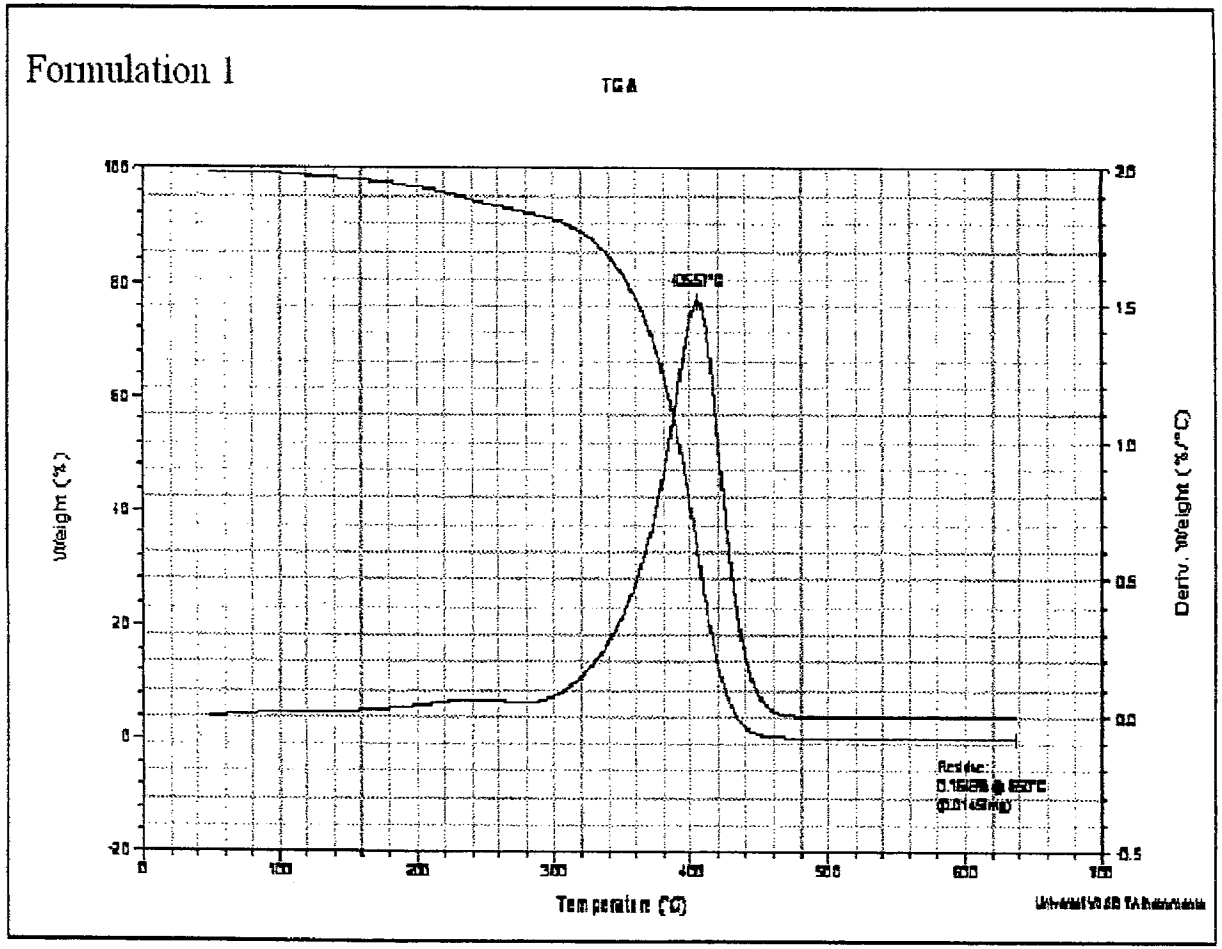
FIG. 7 shows thermo gravimetric analysis results for a formulation.

Results for Oil 1 are included in FIG. 6. Results for Formulation 1 are included in FIG. 7. The results show that Formulation 1 is in the same level with oil 1 in the TGA test.

Example 7

Test Mill

Oils and small PSD products are tested at 3 wt %.

Rolling performances of the small particle size (PSD≤1 μm or PSD≤0.5 μm) oil in water lubricant fluid package were evaluated by a 4-high reversing rolling test mill (from The State Key Lab of Rolling and Automation of the Northeast University) with a test procedure correlating to the various production mill processes, tandem or reversing. Because of technical limitations of the mill, two processes have been designed. In Process 1, pass 5 is a higher speed process (4 m/s), and in process 2, pass 5 is a slow speed process (1 m/s) followed by pass 6 going to thinner gauge. The test procedure is presented below:

Process 1:

| Pass | Entry gauge (mm) | Exit gauge (mm) | Reduction (%) | Speed (m/s) | Front tension (MPa) | Back tension (MPa) |
|---|---|---|---|---|---|---|
| 1 | 2.00 | 1.80 | 10 | 0.2 | 70 | 70 |
| 2 | 1.80 | 0.95 | 43 | 0.5 | 70 | 70 |
| 3 | 0.95 | 0.55 | 42 | 1 | 80 | 80 |
| 4 | 0.55 | 0.35 | 36 | 1 | 80 | 80 |
| 5 | 0.35 | 0.28 | 20 | 4 | 85 | 85 |

Results 1:

| Pass | Oil 1 Unit roll force KN/mm | Oil 2 Unit roll force KN/mm | Formulation 1 Unit roll force KN/mm | Formulation 2 Unit roll force KN/mm |
|---|---|---|---|---|
| 1 | 930 | 944 | 917 | 889 |
| 2 | 581 | 582 | 552 | 560 |
| 3 | 1094 | 1171 | 1103 | 1088 |
| 4 | 2044 | 2274 | 2050 | 2050 |
| 5 | 3715 | 4487 | 4143 | 4143 |

Process 2:

| Pass | Enter gauge (mm) | Exit gauge (mm) | Reduction (%) | Speed (m/s) | Front tension (MPa) | Back tension (MPa) |
|---|---|---|---|---|---|---|
| 1 | 2.00 | 1.80 | 10 | 0.2 | 70 | 70 |
| 2 | 1.80 | 0.95 | 43 | 0.5 | 70 | 70 |
| 3 | 0.95 | 0.55 | 42 | 1 | 80 | 80 |
| 4 | 0.55 | 0.35 | 36 | 1 | 80 | 80 |
| 5 | 0.35 | 0.24 | 31 | 1 | 85 | 85 |
| 6 | 0.24 | 0.17 | 29 | 1 | 75 | 75 |

Result 2:

| Pass | Oil 1 Unit roll force KN/mm | Oil 2 Unit roll force KN/mm | Formulation 1 Unit roll force KN/mm | Formulation 2 Unit roll force KN/mm |
|---|---|---|---|---|
| 1 | 930 | 944 | 917 | 889 |
| 2 | 581 | 582 | 552 | 560 |
| 3 | 1094 | 1171 | 1103 | 1088 |
| 4 | 2044 | 2274 | 2050 | 2050 |
| 5 | 3344 | 3732 | 3455 | 3682 |
| 6 | 5134 | 6354 | 5643 | 5714 |

The unit roll forces of Formulation 1 and Formulation 2 are at the same level as those of oil 1 and oil 2.

Figure 8:
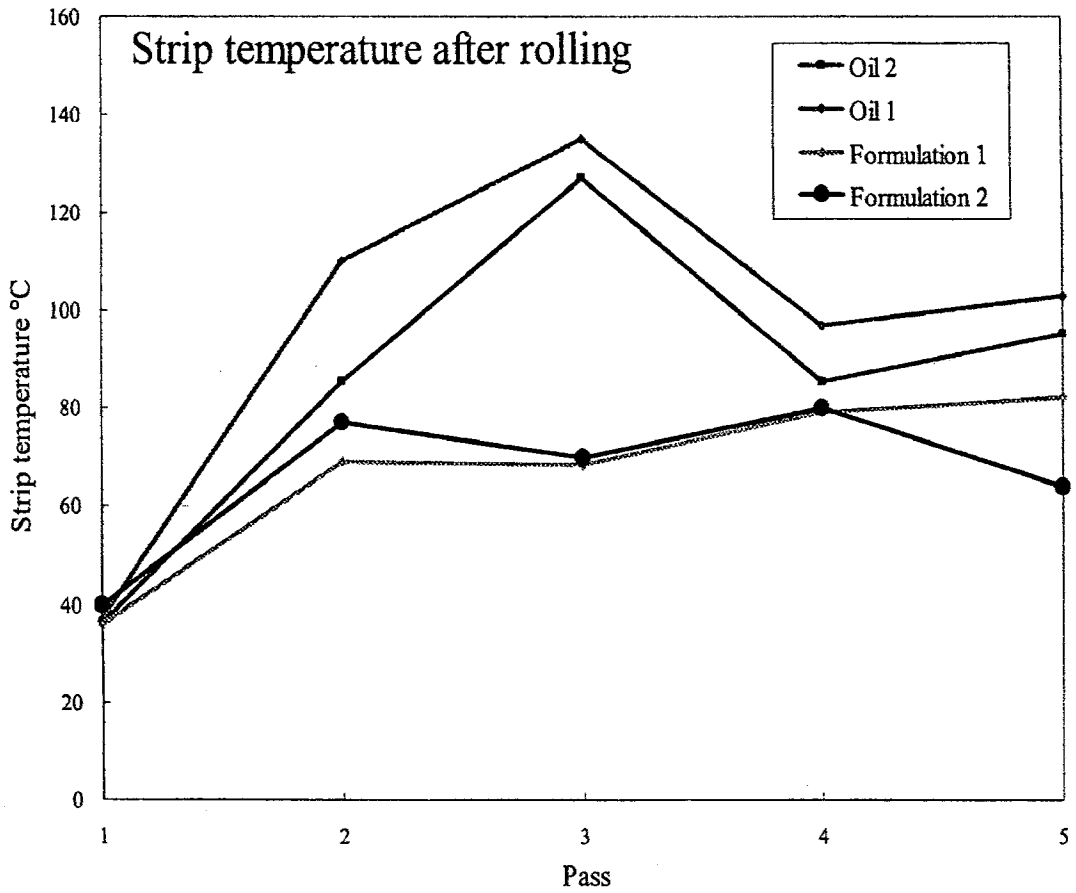
FIG. 8 shows strip temperature after rolling for various formulations and reference oils.
Figure 9:
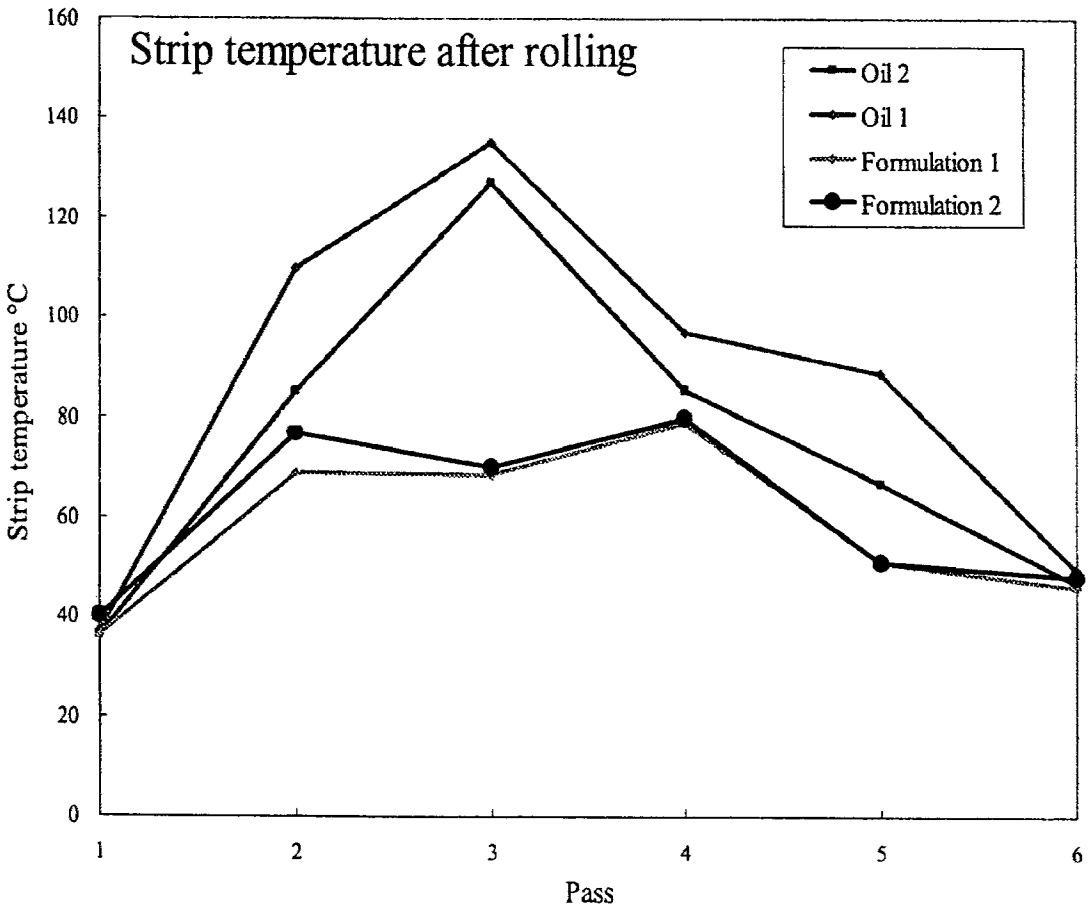
FIG. 9 shows strip temperature after rolling for various formulations and reference oils.

The strip temperatures after each pass are shown in FIGS. 8 and 9. FIG. 8 includes results for Process 1. FIG. 9 includes results for Process 2.

The results show that the strip temperature of formulation 1 and formulation 2 is lower than the strip temperature after rolling with oil 1 and oil 2 after each pass. The results show that the cooling-ability of the small particle size (PSD≤1 μm or PSD≤0.5 μm) oil in water lubricants, formulation 1 and formulation 2, exceeds that of the emulsions of oil 1 and oil 2.

Example 8

Test Mill

An additional formulation was prepared and tested for rolling performance.

Formulation 4:

The composition of the oil phase is as follows:

| | |
|---|---|
| Palm oil: | 58.00 wt. % |
| Branched polymeric surfactant (MW: 3000-70000): | 30.00 wt. % |
| Fatty acid: | 3.25 wt. % |
| P donor 1: | 1.25 wt. % |
| P donor 2: | 1.00 wt. % |
| P donor 3: | 1.00 wt. % |
| S donor 1: | 4.50 wt. % |
| Benzotriazole: | 0.25 wt. % |
| Alkylated Amino phenol: | 0.75 wt. % |
| Total: | 100.00 wt. % |

3 wt. % of above oil phase was dispersed into water.
PSD: 0.13 μm

Figure 10:
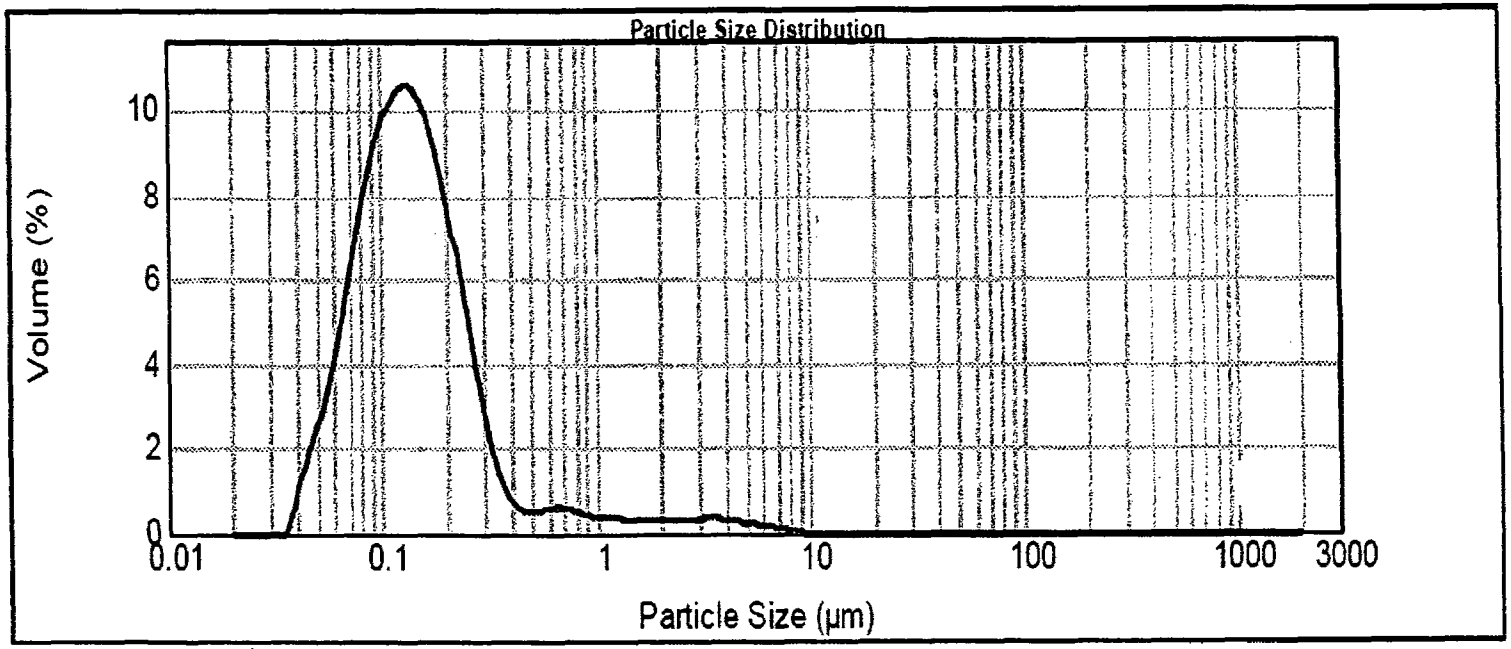
FIG. 10 shows particle size distribution of a formulation about 0.13 μm.

Formulation 4 PSD about 0.13 μm is shown in FIG. 10.

TABLE 4

| The PSD of Formulation 4 with PSD d (50%) 0.13 μm | |
|---|---|
| Size (μm) | Vol Under % |
| 0.020 | 0.00 |
| 0.022 | 0.00 |
| 0.025 | 0.00 |
| 0.028 | 0.00 |

TABLE 4-continued

| The PSD of Formulation 4 with PSD d (50%) 0.13 μm | |
|---|---|
| Size (μm) | Vol Under % |
| 0.032 | 0.00 |
| 0.036 | 0.00 |
| 0.040 | 0.24 |
| 0.045 | 1.25 |
| 0.050 | 2.85 |
| 0.056 | 5.16 |
| 0.063 | 8.27 |
| 0.071 | 12.41 |
| 0.080 | 17.63 |
| 0.089 | 23.82 |
| 0.100 | 30.80 |
| 0.112 | 38.35 |
| 0.126 | 46.25 |
| 0.142 | 54.22 |
| 0.159 | 61.97 |
| 0.178 | 69.23 |
| 0.200 | 75.72 |
| 0.224 | 81.20 |
| 0.252 | 85.55 |
| 0.283 | 88.73 |
| 0.317 | 90.86 |
| 0.356 | 92.18 |
| 0.399 | 92.95 |
| 0.448 | 93.43 |
| 0.502 | 93.80 |
| 0.564 | 94.19 |
| 0.632 | 94.63 |
| 0.710 | 95.09 |
| 0.796 | 95.52 |
| 0.893 | 95.88 |
| 1.002 | 96.18 |
| 1.125 | 96.45 |
| 1.262 | 96.71 |
| 1.416 | 96.96 |
| 1.589 | 97.20 |
| 1.783 | 97.42 |
| 2.000 | 97.64 |
| 2.244 | 97.85 |
| 2.518 | 98.07 |
| 2.825 | 98.31 |
| 3.170 | 98.56 |
| 3.557 | 98.82 |
| 3.991 | 99.07 |
| 4.477 | 99.31 |
| 5.024 | 99.51 |
| 5.637 | 99.67 |
| 6.325 | 99.80 |
| 7.096 | 99.91 |
| 7.962 | 99.97 |
| 8.934 | 100.00 |
| 10.024 | 100.00 |
| 11.247 | 100.00 |
| 12.619 | 100.00 |
| 14.159 | 100.00 |
| 15.887 | 100.00 |
| 17.825 | 100.00 |
| 20.000 | 100.00 |
| 22.440 | 100.00 |
| 25.179 | 100.00 |
| 28.251 | 100.00 |
| 31.698 | 100.00 |
| 35.566 | 100.00 |
| 39.905 | 100.00 |
| 44.774 | 100.00 |
| 50.238 | 100.00 |
| 56.368 | 100.00 |
| 63.246 | 100.00 |
| 70.963 | 100.00 |
| 79.621 | 100.00 |
| 89.337 | 100.00 |
| 100.237 | 100.00 |
| 112.468 | 100.00 |
| 126.191 | 100.00 |
| 141.589 | 100.00 |
| 158.866 | 100.00 |
| 178.250 | 100.00 |

TABLE 4-continued

| The PSD of Formulation 4 with PSD d (50%) 0.13 μm | |
|---|---|
| Size (μm) | Vol Under % |
| 200.000 | 100.00 |
| 224.404 | 100.00 |
| 251.785 | 100.00 |
| 282.508 | 100.00 |
| 316.979 | 100.00 |
| 355.656 | 100.00 |
| 399.052 | 100.00 |
| 447.744 | 100.00 |
| 502.377 | 100.00 |
| 563.677 | 100.00 |
| 632.456 | 100.00 |
| 709.627 | 100.00 |
| 796.214 | 100.00 |
| 893.367 | 100.00 |
| 1002.374 | 100.00 |
| 1124.683 | 100.00 |
| 1261.915 | 100.00 |
| 1415.892 | 100.00 |
| 1588.656 | 100.00 |
| 1782.502 | 100.00 |
| 2000.000 | 100.00 |

Rolling performance of the small particle size (PSD≤1 μm or PSD≤0.5 μm) oil in water lubricant fluid package was evaluated by a 4-high reversing production mill with width 1450 mm The work roll diameter is about 350 mm. The used strips are SPHC strips with 3.1 mm thickness and 1010 mm width.

A constant roll force of about 650 ton to about 700 ton was controlled at every pass. A traditional emulsion product used in this production mill was used as a comparison reference (referred to as "oil 4").

With this rolling procedure, improved lubrication is understood to result in a thinner exit strip thickness after six passes. The results for three tests with small particle size (PSD≤1 μm or PSD≤0.5 μm) oil in water lubricant fluid package (formulation 4) and two tests with reference product (oil 4) are shown in the table below:

| | Oil 4 | Oil 4 | Formulation 4 | Formulation 4 | Formulation 4 |
|---|---|---|---|---|---|
| Concentration % | 3.8 | 2.0 | 3.6 | 2.8 | 1.5 |
| Strip thickness after 6 passes, mm | 1.20 | 1.20 | 1.05 | 0.97 | 1.10 |

The results show that after six passes, the small particle size (PSD≤1 μm or PSD≤0.5 μm) formulation oil in water lubricant, formulation 4, results in a thinner strip thickness than that of oil 4. Such results demonstrate an improvement for rolling a production mill compared to a conventional rolling emulsion, such as improved lubrication.

Other important performance for a cold rolling lubricant, such as annealing and anti-rust were evaluated with the coils after rolling. The results are shown as below:

| | Oil 4 | Formulation 4 |
|---|---|---|
| Annealing | No annealing issue | No annealing issue |
| Anti-rust | No rust issue | No rust issue |

The results show that the small particle size (PSD≤1 μm or PSD≤0.5 μm) formulation oil in water lubricant, formulation 4, prevents annealing and rust issues as well as a conventional rolling emulsion.

We claim:

1. An oil in water lubricant fluid for use in steel cold rolling, comprising an oil in water emulsion, wherein the oil in water emulsion comprises:

(a) an oil phase, comprising about 15 wt % to about 30 wt % polymeric surfactant, wherein at least one polymeric surfactant comprises hydrophilic blocks having a number average molecular weight of at least about 200, about 25 wt % to about 95 wt % base oil, and about 2 wt % to about 8 wt % extreme pressure lubrication additive, the extreme pressure lubrication additive being distinct from the polymeric surfactant, and (b) a water phase, wherein at least about 50% the oil phase is contained in particles with a size of less than 1 μm.

2. The oil in water lubricant fluid of claim 1, further comprising about 0.5 wt % to about 6 wt % functional additive in the oil phase.

3. The oil in water lubricant fluid of claim 1, comprising about 0.5 wt % to about 15 wt % of oil phase.

4. The oil in water lubricant fluid of claim 1, wherein at least one polymeric surfactant has an average molecular weight of about 1,000 to about 100,000.

5. The oil in water lubricant fluid of claim 1, wherein at least one polymeric surfactant comprises graft block polymer surfactant.

6. The oil in water lubricant fluid of claim 1, wherein at least one polymeric surfactant comprises hydrophobic blocks having a number average molecular weight at least about 200.

7. The oil in water lubricant fluid of claim 1, wherein the base oil comprises a natural ester, synthetic ester, mineral oil, or mixtures thereof.

8. The oil in water lubricant fluid of claim 1, wherein the extreme pressure lubrication additive comprises one or more additives which are phosphorus based, sulfur based, or a mixture thereof.

9. The oil in water lubricant fluid of claim 1, wherein the emulsion comprises oil phase particles having a particle size modal value d(50%) of about 1 μm or less.

10. The oil in water lubricant fluid of claim 1, wherein at least about 50% of the oil phase is contained in particles with a size of less than about 0.5 μm.

11. A method of cold rolling steel, comprising lubricating the steel with a lubricant fluid comprising an oil in water emulsion, wherein the emulsion comprises:

(a) an oil phase, comprising about 15 wt % to about 30 wt % polymeric surfactant, wherein at least one polymeric surfactant comprises hydrophilic blocks having a number average molecular weight of at least about 200, about 25 wt % to about 95 wt % base oil, and about 2 wt % to about 8 wt % extreme pressure lubrication additive, the extreme pressure lubrication additive being distinct from the polymeric surfactant; and (b) a water phase;

wherein at least about 50% the oil phase is contained in particles with a size of less than 1 μm.

12. The method of claim 11, wherein the emulsion comprises oil phase particles having a particle size modal value d(50%) of about 1 μm or less.

13. The method of claim 11, wherein the lubricant fluid further comprises about 0.5 wt % to about 6 wt % functional additive in the oil phase.

14. The method of claim 11, wherein the lubricant fluid comprises about 0.5 wt % to about 15 wt % of oil phase.

15. The method of claim 11, wherein at least one polymeric surfactant has an average molecular weight of about 1,000 to about 100,000.

16. The method of claim 11, wherein at least one polymeric surfactant comprises graft block polymer surfactant.

17. The method of claim 11, wherein at least one polymeric surfactant comprises hydrophobic blocks having a number average molecular weight of at least about 200.

18. The method of claim 11, wherein the base oil comprises a natural ester, synthetic ester, mineral oil, or mixtures thereof.

19. The method of claim 11, wherein the extreme pressure lubrication additive comprises one or more additives which are phosphorus based, sulfur based, or a mixture thereof.

20. The method of claim 11, wherein at least about 50% of the oil phase is contained in particles with a size of less than about 0.5 μm.

* * * * *